US009336720B2

(12) United States Patent
Liu

(10) Patent No.: US 9,336,720 B2
(45) Date of Patent: May 10, 2016

(54) ORGANIC LIGHT-EMITTING DIODE DISPLAY PANEL

(71) Applicant: AU Optronics Corporation, Hsin-Chu (TW)

(72) Inventor: Kuang-Hsiang Liu, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 247 days.

(21) Appl. No.: 14/228,547

(22) Filed: Mar. 28, 2014

(65) Prior Publication Data

US 2015/0002377 A1 Jan. 1, 2015

(30) Foreign Application Priority Data

Jul. 1, 2013 (TW) ..... 102123488 A

(51) Int. Cl.
*G09G 3/30* (2006.01)
*G09G 3/32* (2016.01)

(52) U.S. Cl.
CPC ..... *G09G 3/3258* (2013.01); *G09G 2300/0871* (2013.01); *G09G 2310/0286* (2013.01); *G09G 2320/0233* (2013.01); *G09G 2320/045* (2013.01)

(58) Field of Classification Search
USPC ..... 345/76–78
See application file for complete search history.

(56) References Cited

U.S. PATENT DOCUMENTS

| | | | | |
|---|---|---|---|---|
| 7,414,599 | B2 | 8/2008 | Chung et al. | |
| 2008/0143706 | A1* | 6/2008 | Kim | G09G 3/3266 345/213 |
| 2011/0041020 | A1* | 2/2011 | Liu | G01R 31/318536 714/731 |
| 2011/0091006 | A1 | 4/2011 | Liu et al. | |
| 2012/0320021 | A1 | 12/2012 | Chang et al. | |
| 2013/0135284 | A1 | 5/2013 | Tseng et al. | |
| 2013/0241812 | A1* | 9/2013 | Fujikawa | G09G 5/003 345/84 |

FOREIGN PATENT DOCUMENTS

TW 201322236 6/2013

* cited by examiner

*Primary Examiner* — Joseph Haley
*Assistant Examiner* — Ifedayo Iluyomade
(74) *Attorney, Agent, or Firm* — WPAT, PC; Justin King

(57) ABSTRACT

An organic light-emitting diode display panel is disclosed herein. The organic light-emitting diode display panel includes display units. Each of display units includes an organic light-emitting element, a light-driving circuit and stages of shift register connected in series. The light-driving circuit drives the organic light-emitting element according to a light-emitting control signal. Each of the stages of the shift register includes a shift register circuit and a control signal output circuit. The shift register circuit generates a current stage shift signal according to a previous stage shift signal and a first clock signal. The control signal output circuit outputs the light-emitting control signal according to the current stage shift signal and a previous stage carry signal. The enabling period of the light-emitting control signal is determined by the time period between the enabling period of the current stage shift signal and the previous stage carry signal.

17 Claims, 5 Drawing Sheets

ORGANIC LIGHT-EMITTING DIODE DISPLAY PANEL

RELATED APPLICATIONS

This application claims priority to Taiwan Application Serial Number 102123488, filed Jul. 1, 2013, which is herein incorporated by reference.

BACKGROUND

1. Field of Invention

The present invention relates to an OLED display panel. More particularly, the present invention relates to a shift register of the OLED display panel.

2. Description of Related Art

With the rapid development of display technology, flat-panel displays have been widely utilized in daily life. Among the flourishing flat-panel displays, active matrix organic light-emitting diode (AMOLED) display is one of the most popular for its high definition, high contrast ratio and the high response speed.

However, under a long-term use, the pixels of the AMOLED panel deteriorate due to aging or unexpected variations from the manufacturing process, causing a mura issue in the AMOLED panel and reducing the display quality.

FIG. 1 is schematic diagram of a pixel compensation circuit in applications. As shown in FIG. 1, the pixel compensation circuit is configured to drive OLED in accordance with the light-emitting signal EM and the scan signals S1 and S2. The pixel compensation circuit includes a light-driving circuit 224 and OLED D1, and the period of the light-emitting signal EM is fixed and double to the scan signals S1 and S2. By using the light-driving circuit 224 to compensate the threshold voltage of the transistor T4, the variations from the manufacturing process are able to be improved. However, the decrease in the luminance of the OLED due to the component aging still exist, particularly in an operation at low gray scale. U.S. Pat. No. 7,414,599, incorporated by reference, discloses the general information about structures and operations of the pixel compensation circuits, and thus are not repeated herein.

In general, the OLED is able to be driven with different light-emitting period, and, at the same time, the driving current is increased to increase the luminance in display, so as to improve the mura issues. However, the light-emitting period is usually fixed in the conventional pixel compensation circuits (e.g., the pixel compensation circuit 100).

Therefore, a heretofore-unaddressed need exists to adjust the light-emitting periods of the OLED in the display with the conventional pixel compensation circuits.

SUMMARY

It is to be understood that both the foregoing general description and the following detailed description are by examples, and are intended to provide further explanation of the invention as claimed.

One aspect of the present disclosure provides an organic light-emitting diode display panel, and the light-emitting period of the light-emitting elements in the organic light-emitting diode display panel is able to be adjusted. The organic light-emitting diode display panel includes display units, data lines and scan lines. A pixel array is formed by the interleaving data lines and the scan lines. Each of display units is disposed in the pixel array, and includes an organic light-emitting element, a light-driving circuit and stages of shift register coupled in series. The light-driving circuit is configured to drive the organic light-emitting element in accordance with a light-emitting control signal. The stages of shift register are electrically coupled to the display units and configured to provide the light-emitting control signal for each of the display units. Each of the stages of the shift register includes a shifter register circuit and a control signal output circuit. The shifter register circuit is configured to generate a current stage shift signal in accordance with a previous stage shift signal and a first clock signal. The control signal output circuit is electrically coupled to the shift register circuit and a corresponding one of the display units, and is configured to output a current stage carry signal in accordance with a previous stage carry signal and the first clock signal, and configured to output the light-emitting control signal in accordance with the current stage shift signal and the previous stage carry signal, In summary, the technical solution of the present disclosure has obvious advantages and beneficial effects as compared with the prior art. Through the above technical solution, considerable advances in technology and extensive industrial applicability can be achieved. According to the present disclosure, the enabling period of the light-emitting control signal is able to be adjusted by utilizing the two extra signals (i.e., the current stage shift signal and the previous stage carry signal), and the mura issues in the OLED display are improved.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

The following embodiments are disclosed with accompanying diagrams for detailed description. For illustration clarity, many details of practice are explained in the following descriptions. However, it should be understood that these details of practice do not intend to limit the present disclosure. That is, these details of practice are not necessary in parts of embodiments of the present disclosure. Furthermore, for simplifying the drawings, some of the conventional structures and elements are shown with schematic illustrations.

The terms used in this specification generally have their ordinary meanings in the art, within the context of the disclosure, and in the specific context where each term is used. Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section.

It will be understood that while an element is referred to as being "connected" or "coupled" to another element, it can be directly connected or coupled to the other element or intervening elements may be present. In contrast, while an element is referred to as being "directly connected" or "directly coupled" to another element, there are no intervening elements present.

Figure 1:
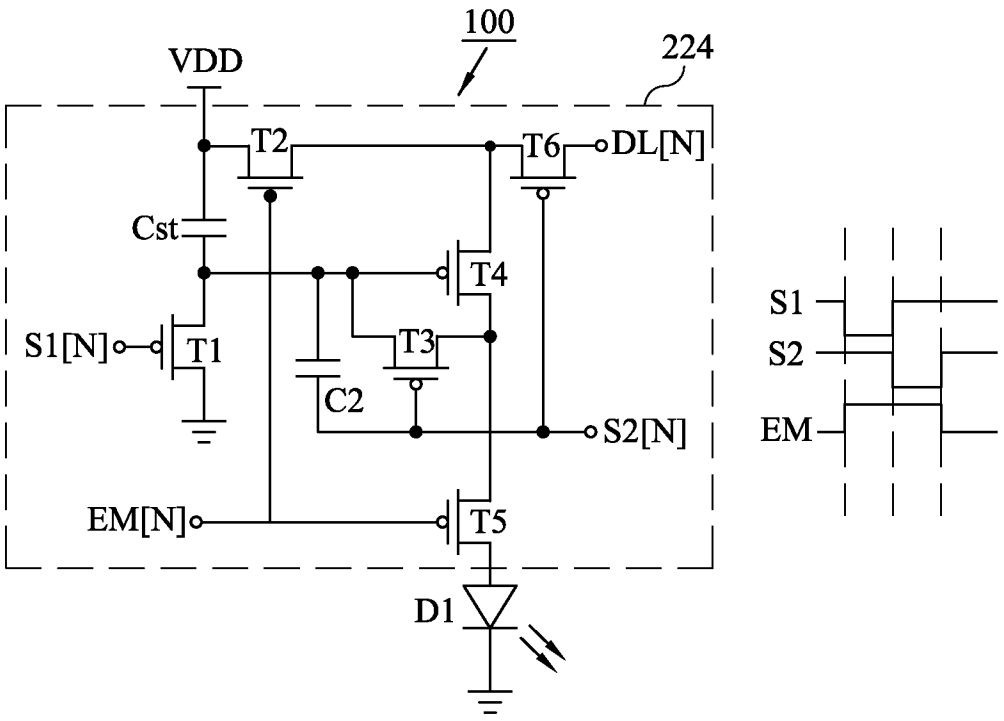
FIG. 1(PRIOR ART)
FIG. 1 is schematic diagram of a pixel compensation circuit in applications.
Figure 2A:
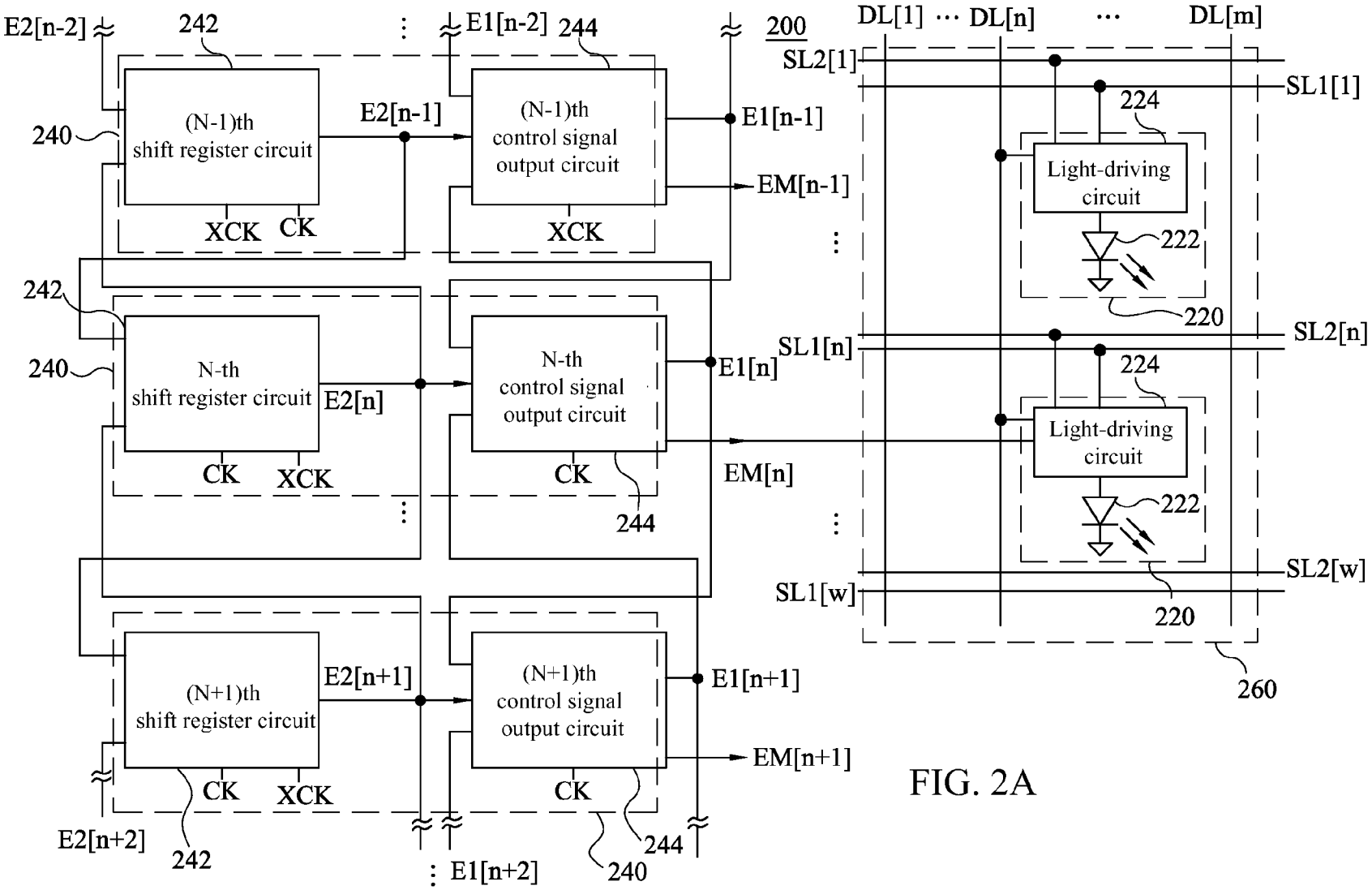
FIG. 2A is a schematic diagram of an organic light-emitting diode display panel in accordance with one embodiment of the present disclosure.

FIG. 2A is a schematic diagram of an organic light-emitting diode display panel in accordance with one embodiment of the present disclosure. As shown in FIG. 2A, the organic light-emitting diode display panel 200 includes data lines DL[1]~DL[m], the scan lines SL[1]~SL1[*w*], SL2[1]~SL2[*w*], display units 220 and stages of shift register 240 coupled in series. A pixel array 260 is formed by the interleaving data lines DL[1]~DL[n] and scan lines SL1[1]~SL1[*w*], SL2[1]~SL2[*w*]. Scan lines SL1[1]~SL1[*w*], SL2[1]~SL2[*w*] are configured to provide different scan signals. The display units 220 are disposed in the pixel array 260, and each of the display units 220 includes an organic light-emitting element 222 and light-driving circuit 224. The light-driving circuit 224 is configured to drive the organic light-emitting elements 222 in accordance with a light-emitting control signal EM[n]. The light-driving circuit 224 includes any types of pixel compensation circuits. For illustration, the light-driving circuit 224 includes the pixel compensation circuit 100 in FIG. 1, and the organic light-emitting element 222 includes an organic light-emitting diode (OLED), which corresponds to the OLED D1 in FIG. 1. Each of the stages of shift register 240 coupled in series includes a shifter register circuit 242 and control signal output circuit 244. Take the N-th stage of shift register 240 as example, the shift register circuit 242 is configured to output a current stage shift signal E2[*n*] in accordance with a previous stage shift signal E2[*n*−1] and a first clock signal CK. The control signal output circuit 244 is electrically coupled to the shift register circuit 242 and a corresponding display unit 220. The control signal output circuit 244 is configured to output a current stage carry signal E1[*n*] in accordance with a previous stage carry signal E1[*n*−1] and the first clock signal CK. In addition, the control signal output circuit 244 further output the aforementioned light-emitting control signal EM[n] in accordance with the current stage shift signal E2[*n*] and the previous stage carry signal E1[*n*−1]. An enabling period of the light-emitting control signal EM[n] is determined by the enabling period of the current stage shift signal E2[*n*] and the enabling period of the previous stage carry signal E1[*n*−1]. For illustration, the enabling period of the light-emitting control signal EM[n] is controlled by the time going from a disable state to an enable state of the current stage shift signal E2[*n*] and the time going from the disable state to the enable state of the previous stage carry signal E1[*n*−1].

The following paragraphs in the present disclosure will provide certain embodiments, which are utilized to implement the functions and operations of the organic light-emitting diode display panel 200. However, the present disclosure is not limited by the following embodiments.

Figure 2B:
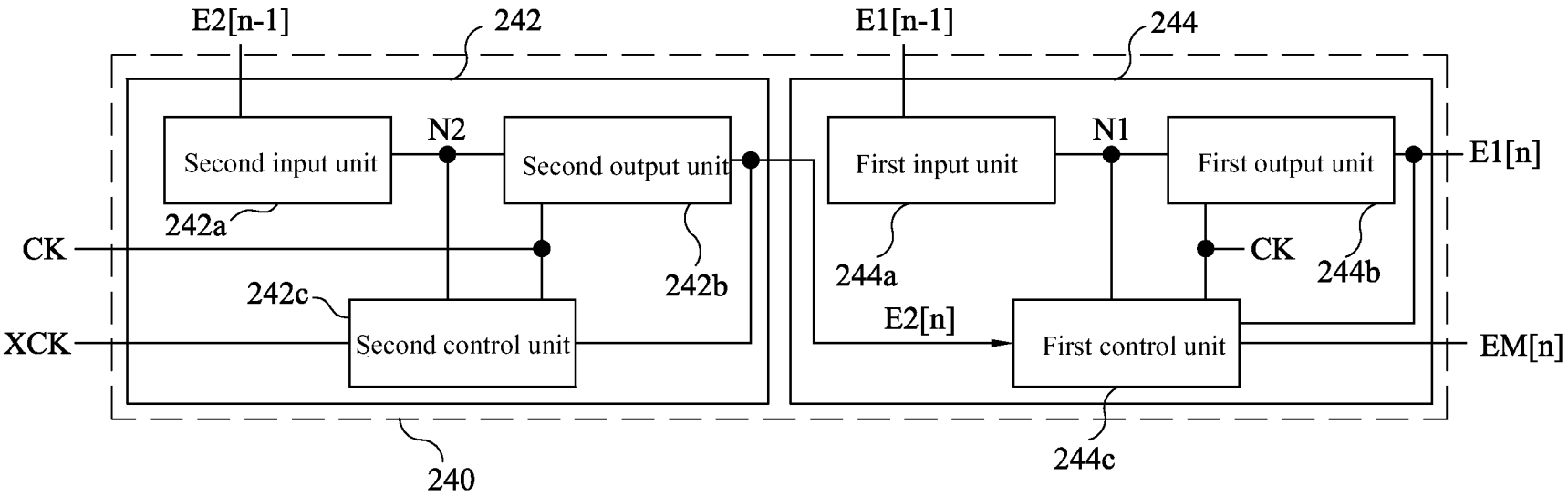
FIG. 2B is a schematic diagram of the shift register in FIG. 2A in accordance with one embodiment of the present disclosure.

FIG. 2B is a schematic diagram of the shift register in FIG. 2A in accordance with one embodiment of the present disclosure. As shown in FIG. 2B, the control signal output circuit 244 further includes a first input unit 244*a*, a first output unit 244*b* and a first control unit 244*c*. The first input unit 244*a* is electrically coupled at a previous carry signal output terminal, and the first input unit 244*a* includes an output terminal. An input terminal of the first output unit 244*b* is electrically coupled to the output terminal of the first input unit 244*a*, and an output terminal of the first output unit 244*b* is electrically coupled at a current stage carry signal output terminal. The first control signal 244*c* is electrically coupled at the output terminal of the first input unit 244*a* and a current stage shift signal output terminal. The output terminal of the first control unit 244*c* is electrically coupled to a light-emitting control signal output terminal to output the aforementioned light-emitting control signal EM[n].

In operation, the first input unit 244*a* in this embodiment is configured to control a voltage level of a first operation node (i.e., the output terminal of the first input unit 244*a*) in accordance with the previous stage carry signal E1[*n*−1]. The first output unit 244*b* is electrically coupled to the first input unit 244*a* at the first operation node N1, and the first output unit 244*b* is configured to generate the aforementioned current stage carry signal E1[*n*] in accordance with the voltage level of the first operation node N1 and the first clock signal CK. The first control unit 244*c* is electrically coupled to the first input unit 244*a* and the first output unit 244*b* at the first operation node N1. The first control unit 244*c* is configured to generate the light-emitting control signal EM[n] with a first voltage level VGH in accordance with the voltage level of the first operation node N1, and to generate the light-emitting control signal EM[n] with a second voltage level VGL in accordance with the current stage shift signal E2[*n*]. Moreover, in this embodiment, the aforementioned first voltage VGH is a driving voltage with a relative high level, and the aforementioned second voltage VGL is the driving voltage with a relative low level.

Figure 2C:
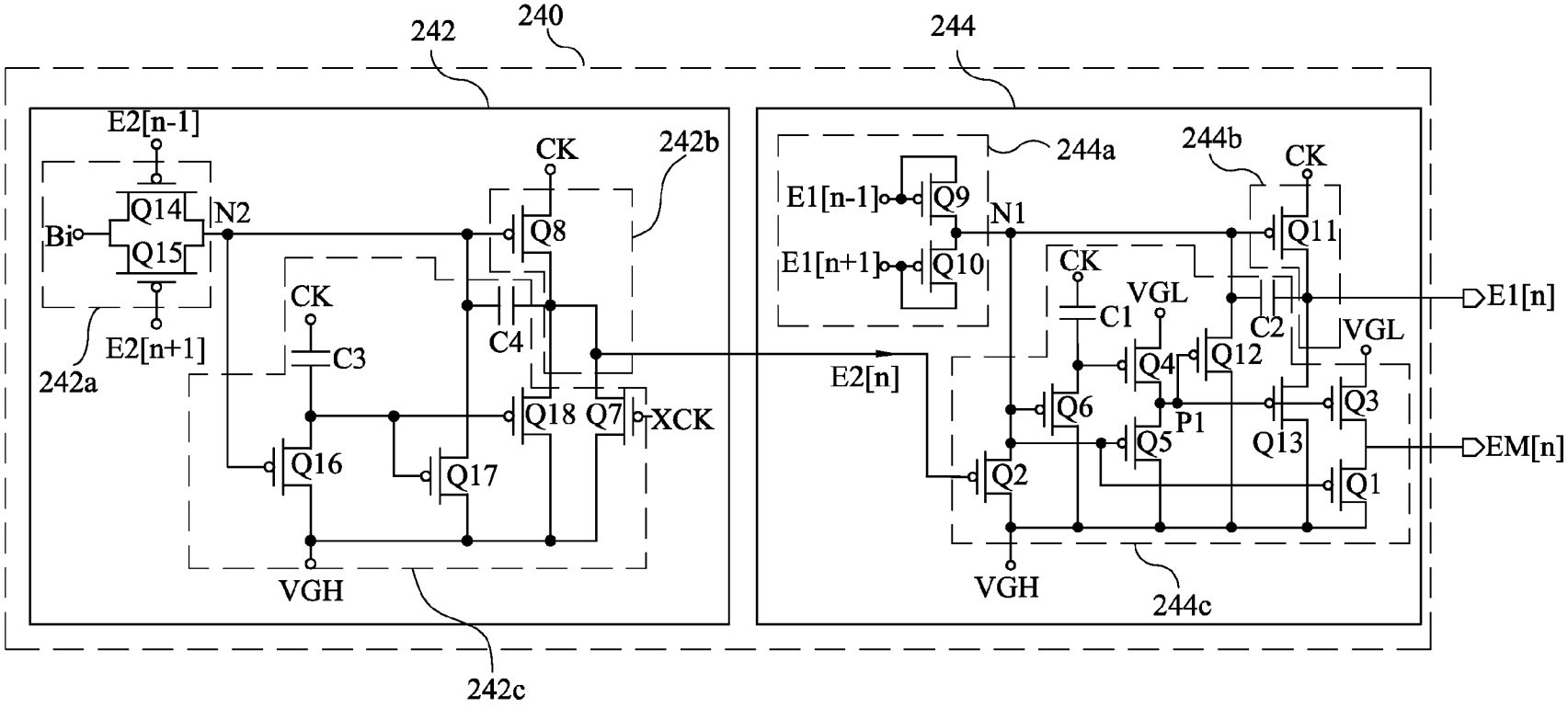
FIG. 2C is a schematic diagram of an internal circuit of a shift register in accordance with one embodiment of the present disclosure.

FIG. 2C is a schematic diagram of an internal circuit of a shift register in accordance with one embodiment of the present disclosure. For illustration, the first input unit 244*a* includes a switch Q9. In addition, the first input unit 244*a* further includes a switch Q10, which is able to be applied to the register with bi-directional transmission, and is thus optionally utilized. A first terminal and a control terminal of the switch Q9 are electrically coupled the previous stage carry signal output terminal, and configured to receive the previous stage carry signal E1[*n*−1]. The first terminal and the control terminal of the switch Q10 are electrically coupled to a next stage carry signal output terminal, and configured to receive a next stage carry signal E1[*n*+1]. Both of the second terminals of the switch Q9 and the switch Q10 are electrically coupled to the output terminal of the first input unit 244*a* (i.e., the first operation node N1).

On the other hand, the first output unit 244*b* includes switch Q11. The first terminal of the switch Q11 is configured to receive the first clock signal CK, the control terminal of the switch Q11 is electrically coupled to the output terminal of the first input unit 244*a*, and the switch Q11 is electrically coupled at the current stage carry signal output terminal to output the current stage carry signal E1[*n*]. The structures of the first input unit 244*a* and the first output unit 244*b* are only for illustrative purposes, and the present disclosure is not limited thereof.

As shown in FIG. 2C, the first control unit 244*c* further includes a switch Q1. The first terminal of the switch Q1 is electrically coupled to the light-emitting control signal output terminal, the second terminal of the switch Q1 is electrically coupled to the first voltage VGH, and the control terminal of the switch Q1 is electrically coupled to the output terminal of the first input unit 244*a*.

In operation, the switch Q1 is configured to be turned on to pull the light control output terminal to the first voltage VGH in accordance with the voltage level of the first operation node N1, so that the light-emitting control signal EM[n] is at the level of the first voltage VGH. For illustration, the switch Q1 may be a P-type transistor. While the voltage level is the first operation node N1 is at the second voltage VGL, the switch Q1 is turned on to pull the light-emitting control signal output terminal to the first voltage VGH, so as to charge the light-emitting control signal to the level of the first voltage VGH.

Reference is made to FIG. 2C, in another embodiment, the first control unit 244*c* further includes a switch Q2 and a switch Q3. The first terminal of the switch Q2 is electrically coupled to the output terminal of the first input unit 244*a* (i.e., the first operation node N1), the second terminal of the switch Q2 is electrically coupled to the first voltage VGH, and the control terminal of the switch Q2 is electrically coupled to the current stage shift signal output terminal for receiving the current stage shift signal E2[*n*]. The first terminal of the switch Q3 is electrically coupled to the second voltage VGL, the second terminal of the switch Q3 is electrically coupled to the light-emitting control signal output terminal, and the control terminal of the switch Q3 is electrically coupled to a first voltage node P1.

In this embodiment, the switch Q2 is configured to be turned on to pull the first operation node N1 to the first voltage VGH in accordance with the current stage shift signal E2[*n*], so as to turn the switch Q1 off. The switch Q3 is configured to be turned on while the first operation node N1 is pulled to the first voltage VGH, so as to pull the light-emitting control signal output terminal to the second voltage VGL. The light-emitting control signal EM[n] is thus at the level of the second voltage VGH. For illustration, the switch Q2 and the switch Q3 are P-type transistors. While the voltage level of the current stage shift signal E2[*n*] is at the level of the second voltage VGL, the switch Q2 is turned on to electrically couple the first operation node N1 to the first voltage VGH (or the voltage close to the first voltage VGH, which practically exists a voltage difference caused from the switches). Further, as shown in FIG. 2C, while the first operation node N1 is charged to the first voltage VGH, the switch Q5 and switch Q6 are turned off, and the switch Q4 is turned on by the first clock signal CK. Thus, the first voltage node P1 is pulled to the second voltage VGL to turn the switch Q3 on, and the light-emitting control signal output terminal is electrically coupled to the second voltage VLG. The light-emitting control signal EM[n] is thus discharged to the level of the second voltage VGL.

Reference is made to FIG. 2C. In one embodiment of the present disclosure, the aforementioned first control unit 244*s* further includes a switch Q4 and a switch Q5. The first terminal of the switch Q4 is electrically coupled to the second voltage VGL, the second terminal of the switch Q4 is electrically coupled to the first voltage node P1, and the control terminal of the switch Q4 is configured to receive the first clock signal CK through a coupling capacitor C1. The first terminal of the switch Q5 is electrically coupled to the first voltage node P1, the second terminal of the switch Q5 is electrically coupled to the first voltage VGH, and the control terminal of the switch Q5 is electrically coupled to the output terminal of the first input unit 244*a* (i.e., the first operation node N1).

In operation, the switch Q4 is configured to be turned on in accordance with the first clock signal CK, so as to pull the control terminal of the switch Q3 to the second voltage VGL for turning the switch Q3 on. The switch Q5 is configured to be turned on in accordance with the voltage level of the first operation node N1, so as to pull the control terminal of the switch Q3 for turning the switch Q3 off.

For illustration, the switch Q4 and the switch Q5 may be P-type transistor. The switch Q4 is turned on while the voltage level of the first clock signal is at a low level, so as to pull the control terminal of the switch Q3 to the second voltage VGL for turning the switch Q3 on. The light-emitting control signal output terminal is electrically coupled to the second voltage VGL by the operations above. Further, the switch Q5 is turned on while the voltage level of the first clock signal is at a low level, so as to electrically connect the control terminal of the switch Q3 (i.e., the first voltage node P1) to the first voltage VGH. Thus, the control terminal of the switch Q3 is charged to the level of the first voltage VGH for turning the switch Q3 off.

Reference is made to FIG. 2C. In one embodiment of the present disclosure, the first control unit 244*c* further includes switch Q6. The first terminal of the switch Q6 is electrically coupled to the first clock signal CK through the coupling capacitor C1, the second terminal of the switch Q6 is electrically coupled to the first voltage VGH, and the control terminal of the switch Q6 is electrically coupled to the output terminal of the first input unit 244*a* (i.e., the first operation node N1). In operation, the switch Q6 is turned on in accordance with the voltage level of the first operation node N1, so as to pull the control terminal of the switch Q4 to the first voltage VGH for turning the switch Q4 off. The switch Q6 is turned off while the switch Q2 is turned on to pull the first operation node N1 to the first voltage VGH, so as to charge the control terminal of the switch Q4 to the level of the first voltage VGH, and the switch Q4 is thus turned off. Further, while the switch Q6 is turned off, the switch Q4 is able to be turned on by the first clock signal CK.

Moreover, referring to FIG. 2B, the shift register circuit 242 of each embodiments above includes a second input unit 242*a*, a second output unit 242*b* and a second control unit 242*c*. The second input unit 242*a* is electrically coupled to the previous stage shift signal output terminal, and is configured to receive the previous stage shift signal E2[*n*−1]. The second input unit 242*a* includes an output terminal.

The second output stage 242*b* is electrically coupled to the output terminal of the second input unit 242*a* (i.e., a second operation node N2) and receives the first clock signal CK. The output terminal of the second output unit 242*b* is electrically coupled to the current stage shift signal output terminal, and is configured to output the current stage shift signal E2[*n*]. The second control unit 242*c* is electrically coupled to the output terminal of the second input unit 242*a*. That is, the second control unit 242*c* is electrically coupled to the second input unit 242*s* and the second output unit 242*b* at the second operation node N2, and the output terminal of the second control unit 242*c* is electrically coupled to the current stage shift signal output terminal.

In operation, the second input unit 242*a* is configured to control the voltage level of the second operation node N2 in accordance with the previous stage shift signal E2[*n*−1] and bi-directional signal Bi. The second output unit 242*b* is configured to generate current stage shift signal E2[*n*] in accordance with the first clock signal CK and the voltage level of the second operation node N2. The second control unit 242*c* is configured to pull the current stage shift signal output terminal to the first voltage VGH in accordance with the first clock signal CK and the second clock signal XCK. Moreover, the phase of the first clock signal CK is complementary of the phase of the second clock signal XCK.

For illustration, referring to FIG. 2C, the second input unit 242*a* includes switches Q14 and Q15. The first terminal of the switch Q14 is configured to receive the bi-directional signal Bi, the control terminal of the switch Q14 is configured to receive the previous stage shift signal E2[*n*−1], and the second terminal of the switch Q14 is electrically coupled to the second operation node N2. The first terminal of the switch Q15 is electrically coupled the first terminal of the switch Q14, the control terminal of the switch Q15 is configured to receive the next stage shift signal E2[*n*+1], and the second terminal of the switch Q15 is electrically coupled to the second operation node N2. The structure of the second input unit 242*a* is only for illustrative purpose, and the present disclosure is not limited thereof.

Referring to FIG. 2C, in one embodiment, the aforementioned second control unit 242*c* includes switch Q7. The first terminal of the switch Q7 is electrically coupled to the current stage shift signal output terminal, the second terminal of the switch Q7 is electrically coupled to the first voltage VGH, and the control terminal of the switch Q7 is electrically coupled to the second clock signal XCK. In operation, the switch Q7 is configured to be turned on to pull the current stage shift signal output terminal to the first voltage VGH in accordance with the second clock signal XCK, and the current stage shift signal E2[*n*] is at the level of the first voltage VGH.

For illustration, the switch Q7 may be a P-type transistor. The switch Q7 is turned on to electrically couple the current stage shift signal output terminal to the first voltage VGH while the voltage level of the second clock signal XCK is at the low voltage level. The current stage shift signal E2[*n*] is thus charged to the level of the first voltage VGH.

Referring to FIG. 2C, in one embodiment, the aforementioned second output unit 242*b* includes a switch Q8. The first terminal of the switch Q8 is electrically coupled to the first clock signal CK, the control terminal of the switch Q8 is electrically coupled to the output terminal of the second input unit 242*a* (i.e., the second operation node N2), and the second terminal of the switch Q8 is electrically coupled to the current stage shift signal output terminal. In operation, the switch Q8 is configured to be turned on to transmit first clock signal CK to the current stage shift signal output terminal in accordance with the voltage level of the second operation node N2. For illustration, the switch Q8 may be a P-type transistor. The switch Q8 is turned on to transmit the first clock signal to the current stage shift signal output terminal, in accordance with the voltage level of the second operation node N2.

Further, for reducing the noise or offset voltages caused by the first clock signal CK and the second clock signal XCK, the first control unit 244*c* further includes a switch Q12, a switch Q13, a coupling capacitor C1 and a coupling capacitor c2. The first terminal of the switch Q12 is electrically coupled to the first operation node N1, the second terminal of the switch Q12 is electrically coupled to first voltage VGH, and the control terminal of the switch Q12 is electrically coupled to the first voltage node P1. The first terminal of the switch Q13 is electrically coupled to the current stage carry signal output terminal, the second terminal of the switch Q13 is electrically coupled to the first voltage VGH, and the control terminal of the switch Q13 is electrically coupled to the first voltage node P1. The switch Q12 and the switch Q13 are turned on to stably pull the first operation node N1 and the current stage carry signal output terminal to the first voltage VGH, respectively, in accordance with the voltage level of the first voltage node P1.

The capacitor C2 is coupled between the second terminal of the switch Q9 and the first terminals of the switch Q12 and the switch Q13, so as to reduce the noise caused from switching of the first clock signal ck and to filter DC offset voltage on the first clock signal CK. One terminal of the capacitor C1 is coupled to the first terminal of the switch Q6, and the another one terminal of the capacitor C1 is configured to receive the first clock signal CK. Similarly, the aforementioned second control unit may include the similar circuitry structure (i.e., the switches Q17 and Q18, and the capacitors C3 and C4 shown in FIG. 2C), and the repetitious details need not be given here.

Figure 2D:
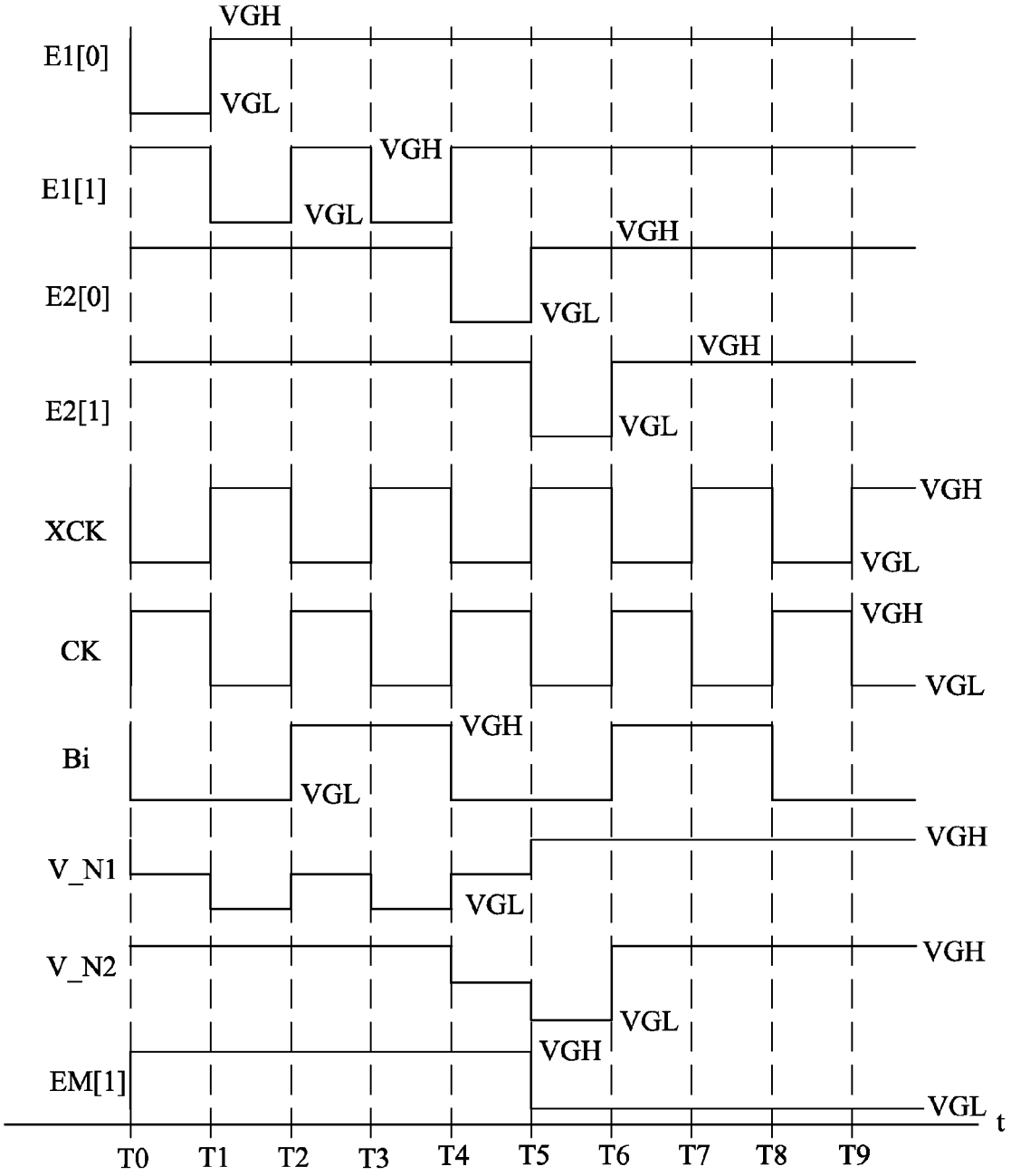
FIG. 2D is a graph illustrating the waveforms of the operation signals in accordance with one embodiment of the present disclosure.

The operations in a single stage of shift register (i.e., the aforementioned organic light-emitting control circuit) are described with the waveforms of the signals. FIG. 2D is a graph illustrating the waveforms of the operation signals in accordance with one embodiment of the present disclosure. For simply illustration, reference is made to both of FIG. 2C and FIG. 2D. The following descriptions are illustrated with the first stage of the shift register (i.e., the n in FIG. 2C is set to 1), the operations of the rest stages may be deduced by analogy.

As shown in FIG. 2D, during time T0 to time T6, the enabling period of light-emitting control signal EM[1] (e.g., T0 to T5) is determined by the time from a disabling period going to a enabling period of the previous stage carry signal E1[0] (e.g., T0 to T1) and the time from the disabling period going to a enabling period of the current stage shift signal E2[1] (e.g., T5 to T6). The corresponding operation of the shift register is described with the FIG. 2C herein.

During the time T0 to time T1, the previous stage carry signal E1[0] is at the level of the second voltage VGL, and the switch Q9 is turned on to transmit the previous stage carry signal E1[0] to the first operation node N1. Thus, the voltage level of the first operation node N1 is reduced to the second voltage VGL (it's assumed that the original voltage level of the first operation node N1 is at a high voltage level). In the mean time, the switch Q1 is turned on to electrically couple the light-emitting control signal output terminal to the first voltage VGH, so as to pull the voltage level of the light-emitting control signal EM[1] to the first voltage VGH. Furthermore, during time T0 to time T1, the switch Q11 is turned on due to the changes in the voltage level of the first operation node N1, and the first clock signal CK is transmitted to the current stage carry signal output terminal. The current stage carry signal E1[1] is thus at the level of the first voltage with the operations of the first clock signal CK.

Afterwards, during time T4 to time T5, the state of the previous stage shift signal E2[0] is transited to the second voltage VGL, and the switch Q 14 is turned on to transmit the bi-direction signal Bi to the second operation node N2. The voltage level of the second operation node N2 is thus reduced to the second voltage VGL (it's assumed that the original voltage level of the second operation node N2 is at the high voltage level). Further, due to the second clock signal XCK is at the level of the second voltage VGL during the time T4 to T5, the switch Q7 is turned on to transmit the first clock signal CK to the current stage shift signal output terminal. Thus, the current stage shift signal E2[1] acts with the first clock signal CK. However, due to the second clock signal is at the level of the second voltage VGL in this time, the switch Q7 is turned on to pull the current stage shift signal output terminal to the first voltage VGH. As a result, the current stage shift signal E2[1] is maintained at the high voltage level during the time T4 to T5.

Further, during time T5 to T6, the switch Q7 is turned off. The current stage shift signal E2[1] transits to the second voltage VGL by acting with the first clock signal CK, and the switch Q2 is thus turned on to pull the first operation node N1 to the first voltage VGH, which turns the switch Q6 off. In the mean time, the switch Q4 is turned on to pull the first voltage node P1 to the second voltage VGL (the first clock signal CK is at the level of the second voltage VGL at this time). The switch Q3 is thus turned on to electrically couple the light-emitting control signal output terminal to the second voltage VGL. As a result, the state of the light-emitting control signal EM1[1] is transited to the level of the second voltage VGL.

As shown in FIG. 2D, the enabling period of the light-emitting control signal E1[1] is determined by the current stage shift signal E2[1] and the previous stage carry signal E1[0]. To be more specifically, the enabling period of light-emitting control signal EM[1] is controlled by the time from a disabling period going to a enabling period of the previous stage carry signal E1[0] and the time from the disabling period going to a enabling period of the current stage shift signal E2[1].

In summary, the shift registers coupled in series in the embodiments is able to generate the light-emitting control signals EM[n] with different enabling periods to drive the light-driving circuits by the cooperative operations of the shift register circuit 242 and the control signal output circuit 244. The aforementioned mura issues in the display is thus improved.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. An organic light-emitting diode display panel, comprising:

a plurality of display units, each of the display units comprising:

an organic light-emitting element; and a light-driving circuit configured to drive the organic light-emitting element in accordance with a light-emitting control signal; and a plurality of stages of shift register coupled in series, the stages of shift register being electrically coupled to the display units and configured to provide the light-emitting control signal for each of the display units, wherein one of the stages of the shift register comprises:

a shifter register circuit configured to generate a current stage shift signal in accordance with a previous stage shift signal and a first clock signal; and a control signal output circuit electrically coupled to the shift register circuit and a corresponding one of the display units, the control signal output circuit being configured to output a current stage carry signal in accordance with a previous stage carry signal and the first clock signal, and configured to output the light-emitting control signal in accordance with the current stage shift signal and the previous stage carry signal, wherein an enabling period of the light-emitting control signal is determined in accordance with the current stage shift signal and the previous stage carry signal.

2. The organic light-emitting diode display panel of claim 1, wherein the control signal output circuit comprises:

a first input unit configured to control a voltage level of a first operation node in accordance with the previous stage carry signal;

a first output unit electrically coupled to the first operation node, the first output unit being configured to generate the current stage carry signal in accordance with the voltage level of the first operation node and the first clock signal; and a first control unit electrically coupled to the first input unit and the first output the first output unit at the first operation node, the first control unit being configured to generate the light-emitting control signal with the voltage level of a first voltage in accordance with the voltage level of the first operation node, and configured to generate the light-emitting control signal with the voltage level of a second voltage in accordance with the current stage shift signal.

3. The organic light-emitting diode display panel of claim 2, wherein the shift register further comprises:

a second input unit configured to transmit a bi-directional signal to a second operation node in accordance with the previous stage shift signal;

a second output unit electrically coupled to the second input unit at the second operation node, and configured to generate the current stage shift signal at a current stage shift signal output terminal in accordance with the voltage level of the second operation node and the first clock signal; and a second control unit electrically coupled to the second input unit and the second output unit at the second operation node, and configured to pull the current stage shift signal output terminal to the first voltage in accordance with the first clock signal and a second clock signal.

4. The organic light-emitting diode display panel of claim 3, wherein the second control unit comprises:

a first switch configured to be turned on to pull the current stage shift output terminal to the first voltage in accordance with the second clock signal, so that the current stage shift signal is at the level of the first voltage.

5. The organic light-emitting diode display panel of claim 4, wherein the second output unit comprises:

a second switch configured to be turned on to transmit the first clock signal to the current stage shift signal output terminal in accordance with the voltage level of the second operation node.

6. The organic light-emitting diode display panel of claim 2, wherein the first control unit comprises:

a first switch configured to be turned on to pull a light-emitting control signal output terminal to the first voltage in accordance with the voltage level of the first operation node, so that the light-emitting control signal is at the first level of the first voltage.

7. The organic light-emitting diode display panel of claim 6, wherein the first control unit further comprises:

a second switch configured to be turned on to pull the first operation node to the first voltage in accordance with the current stage shift signal, so as to turned the first switch off; and a third switch configured to be turned on to pull the light-emitting control signal output terminal to the second voltage while the first operation node is pulled to the first voltage, so that the light-emitting control signal is at the level of the second voltage.

8. The organic light-emitting diode display panel of claim 7, wherein the first control unit further comprises:

a fourth switch configured to be turned on to pull a control terminal of the third switch to the second voltage in accordance with the first clock signal, so as to turn the third switch on; and a fifth switch configured to be turned on to pull the control terminal of the third switch to the first voltage in accordance with the first clock signal, so as to turn the third switch off.

9. The organic light-emitting diode display panel of claim 8, wherein the first control unit further comprises:

a sixth switch configured to be turned on to pull a control terminal of the fourth switch to the first voltage in accordance with the voltage level of the first operation node, so as to turn the fourth switch off, and configured to be turned off while the second switch is turned to pull the first operation node to the first voltage, so that the fourth switch is turned on in accordance with the first clock signal.

10. The organic light-emitting diode display panel of claim 9, wherein the enabling period is determined by the current stage shift signal and the previous stage carry signal.

11. The organic light-emitting diode display panel of claim 6, wherein the enabling period is determined by the current stage shift signal and the previous stage carry signal.

12. The organic light-emitting diode display panel of claim 2, wherein to the shift register further comprises:

a second input unit configured to transmit a bi-directional signal to a second operation node in accordance with the previous stage shift signal;

a second output unit electrically coupled to the second input unit at the second operation node, and configured to generate the current stage shift signal at a current stage shift signal output terminal in accordance with the voltage level of the second operation node and the first clock signal; and a second control unit electrically coupled to the second input unit and the second output unit at the second operation node, and configured to pull the current stage shift signal output terminal to the first voltage in accordance with the first clock signal and a second clock signal.

13. The organic light-emitting diode display panel of claim 12, wherein the second control unit comprises:

a first switch configured to be turned on to pull the current stage shift output terminal to the first voltage in accordance with the second clock signal, so that the current stage shift signal is at the level of the first voltage.

14. The organic light-emitting diode display panel of claim 13, wherein the second output unit comprises:

a second switch configured to be turned on to transmit the first clock signal to the current stage shift signal output terminal in accordance with the voltage level of the second operation node.

15. The organic light-emitting diode display panel of claim 14, wherein the enabling period is determined by the current stage shift signal and the previous stage carry signal.

16. The organic light-emitting diode display panel of claim 2, wherein the enabling period is determined by the current stage shift signal and the previous stage carry signal.

17. The organic light-emitting diode display panel of claim 1, wherein the enabling period is determined by the current stage shift signal and the previous stage carry signal.

* * * * *